US005263720A

United States Patent [19]

Rothermel

[11] Patent Number: 5,263,720

[45] Date of Patent: Nov. 23, 1993

[54] GOLF SWING AND STANCE TRAINING TOOL

[76] Inventor: Philip P. Rothermel, 2043 Mauvilla Cove, Biloxi, Miss. 39531

[21] Appl. No.: 952,323

[22] Filed: Sep. 28, 1992

[51] Int. Cl.[5] ..... A63B 69/36

[52] U.S. Cl. ..... 273/187.2; 273/188 A; 273/187 A

[58] Field of Search ..... 273/188 R, 189 R, 192, 273/187.2, 188 A, 187 A, 187 R, 187 B

[56] References Cited

U.S. PATENT DOCUMENTS

| | | | |
|---|---|---|---|
| 1,684,192 | 9/1928 | Nemeth | 273/188 R |
| 3,820,781 | 6/1974 | Kane | 273/189 R X |
| 5,085,437 | 2/1992 | Leitao | 273/189 R X |

*Primary Examiner*—George J. Marlo

*Attorney, Agent, or Firm*—Leon Gilden

[57] ABSTRACT

A tool structure includes an elongate rigid rod having first and second coaxially aligned legs spaced relative to one another, having a U-shaped bar intermediate the first and second rod legs. The U-shaped bar includes spaced parallel bar legs, wherein one of said bar legs fixedly mounts an alignment rod projecting orthogonally beyond the U-shaped bar and the rigid rod. The U-shaped bar is secured intermediate a golfer's legs, with the alignment rod arranged for orienting a golf club in the proper orientation relative to an individual's hips prior to a golf swing. Resilient "O" rings are provided, with one of said "O" rings mounted upon each of the rod legs, and the "O" rings oriented in a spacing substantially equal to a golfer's shoulder width for indicating position of the golfer's feet prior to a golf swing.

6 Claims, 4 Drawing Sheets

GOLF SWING AND STANCE TRAINING TOOL

BACKGROUND OF THE INVENTION

1. Field of the Invention

The field of invention relates to golf swing apparatus, and more particularly pertains to a new and improved golf swing and stance training tool wherein the same is arranged to permit ease of replication of a golfer's swing and stance in a golfing game.

2. Description of the Prior Art

Golf swing tools as indicated in the U.S. Pat. Nos. 4,927,152; 4,955,612; 4,892,317; 4,930,786; and 4,948,142 have been available in the prior art but have heretofore been of limited applicability in coordinating a golfer's swing and stance, wherein the instant invention attempts to overcome deficiencies of the prior art by providing such an organization in a compact, unitary organization permitting ease of transport and operability in use and in this respect, the present invention substantially fulfills this need.

SUMMARY OF THE INVENTION

In view of the foregoing disadvantages inherent in the known types of golf swing tool structure now present in the prior art, the present invention provides a golf swing and stance training tool wherein the same incorporates a rigid rod having a securement intermediate U-shaped bar, with the U-shaped bar including an alignment rod for positioning of an individual's golf club and ease of securement of the organization in use. As such, the general purpose of the present invention, which will be described subsequently in greater detail, is to provide a new and improved golf swing and stance training tool which has all the advantages of the prior art golf swing tool structure and none of the disadvantages.

To attain this, the present invention provides a tool structure including an elongate rigid rod having first and second coaxially aligned legs spaced relative to one another, having a U-shaped bar intermediate the first and second rod legs. The U-shaped bar includes spaced parallel bar legs, wherein one of said bar legs fixedly mounts an alignment rod projecting orthogonally beyond the U-shaped bar and the rigid rod. The U-shaped bar is secured intermediate a golfer's legs, with the alignment rod arranged for orienting a golf club in the proper orientation relative to an individual's hips prior to a golf swing. Resilient "O" rings are provided, with one of said "O" rings mounted upon each of the rod legs, and the "O" rings oriented in a spacing substantially equal to a golfer's shoulder width for indicating position of the golfer's feet prior to a golf swing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf swing and stance training tool which has all the advantages of the prior art golf swing tool structure and none of the disadvantages.

It is another object of the present invention to provide a new and improved golf swing and stance training tool which may be easily and efficiently manufactured and marketed.

It is a further object of the present invention to provide a new and improved golf swing and stance training tool which is of a durable and reliable construction.

An even further object of the present invention is to provide a new and improved golf swing and stance training tool which is susceptible of a low cost of manufacture with regard to both materials and labor, and which accordingly is then susceptible of low prices of sale to the consuming public, thereby making such golf swing and stance training tool economically available to the buying public.

Still yet another object of the present invention is to provide a new and improved golf swing and stance training tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
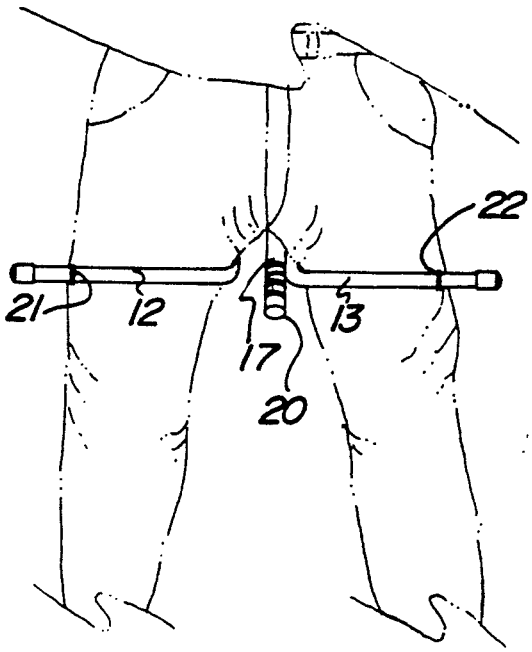
FIG. 1 is an isometric illustration of the invention secured relative to an individual's legs.
Figure 2:
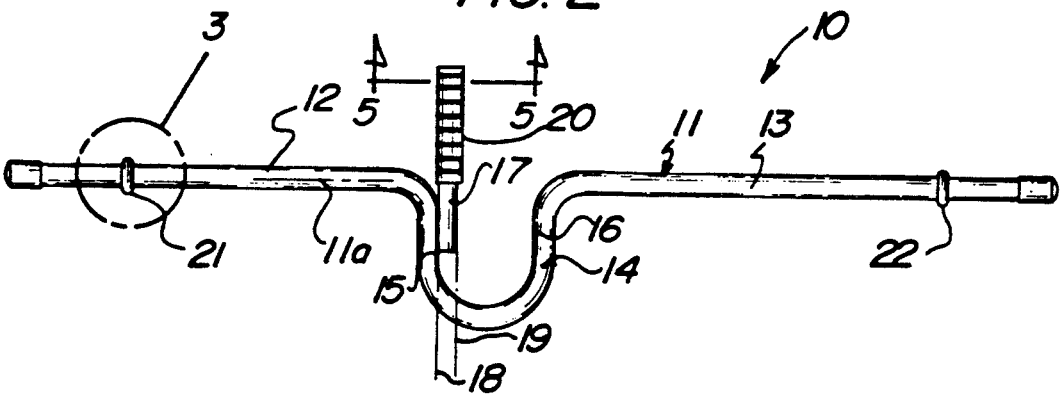
FIG. 2 is an orthographic top view of the invention.
Figure 3:
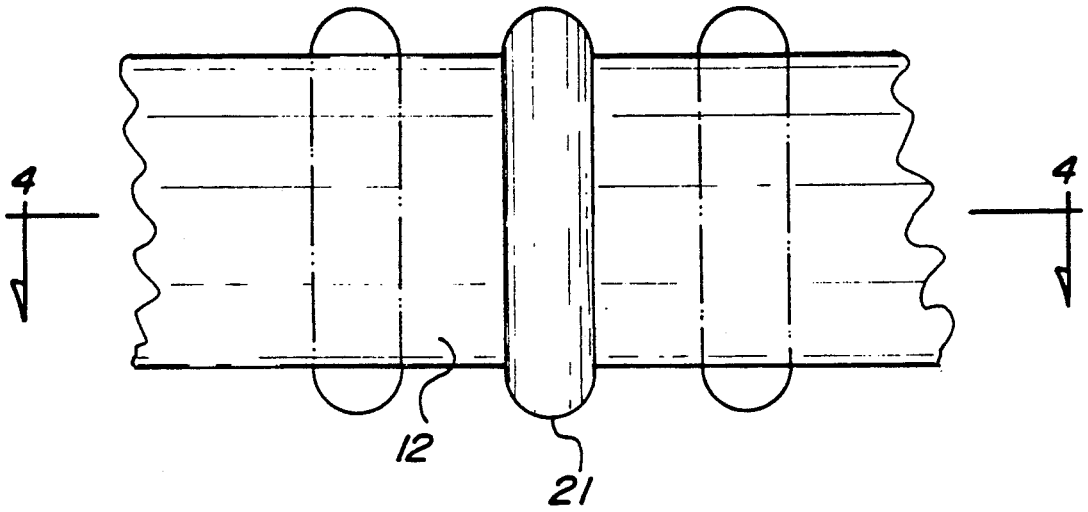
FIG. 3 is an enlarged orthographic view of section 3 as set forth in FIG. 2.
Figure 4:
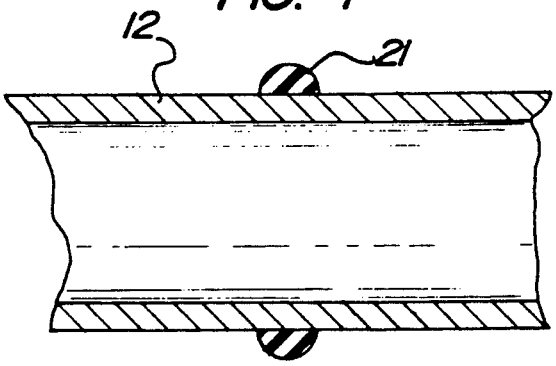
FIG. 4 is an orthographic view, taken along the lines 4—4 of FIG. 3 in the direction indicated by the arrows.
Figure 5:
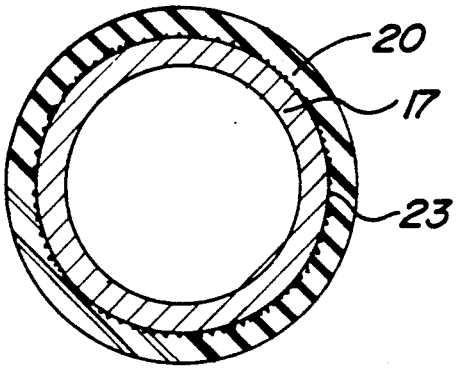
FIG. 5 is an orthographic view, taken along the lines 5—5 of FIG. 2 in the direction indicated by the arrows.

With reference now to the drawings, and in particular to FIGS. 1 to 9 thereof, a new and improved golf swing and stance training tool embodying the principles and concepts of the present invention and generally designated by the reference numeral 10 will be described.

More specifically, the golf swing and stance training tool 10 of the instant invention essentially comprises an elongate rigid rod 11 having a rod first leg 12 spaced from and coaxially aligned with a rod second leg 13 along a rigid rod axis 11*a*.

A U-shaped bar 14 is fixedly mounted intermediate the rod first and second legs 12 and 13, with the U-shaped bar 14 having spaced parallel bar first and second legs 15 and 16. The bar first and second legs are orthogonally oriented relative to the respective rod first and second legs 12 and 13. The bar first leg 15 includes an alignment rod 17 fixedly mounted thereto, with the alignment rod 17 oriented about an alignment rod axis 19, with the bar first leg 15 oriented about a first leg axis 18, with the first leg axis 18 arranged parallel relative to the alignment and rod axis 19. An alignment rod handle 20 is mounted spaced from the U-shaped bar 14 for ease of grasping and manipulation of the organization. A first "O" ring 21 is mounted in frictional engaging relationship relative to the rod first leg 12, with a second "O" ring 22 arranged in a frictionally engaged relationship relative to the rod second leg 13.

In use, the rigid rod 11 is oriented in an adjacency below a golfer's shoulders, such as two inches below the shoulders, with the "O" rings 21 and 22 displaced along the respective rod first and second legs 12 and 13 to an orientation substantially accommodating that golfer's shoulder width. The rigid rod 11 is then positioned upon the ground, wherein the golfer's feet, and particularly the toes, are oriented relative to the first and second "O" rings 21 and 22. The organization is subsequently lifted to an orientation such as indicated in FIG. 1 for right-handed golfers such that the alignment rod 17 is positioned adjacent to and inside a golfer's left leg, and the golf club is positioned to an orientation in adjacency relative to the handle 20, and more particularly to the end of the handle 20 for proper initial orientation of the golf club prior to a golf swing. Proper grasping of the golf club, proper flexing of the legs at the knees, and body orientation, a golf swing may be undertaken.

Figure 6:
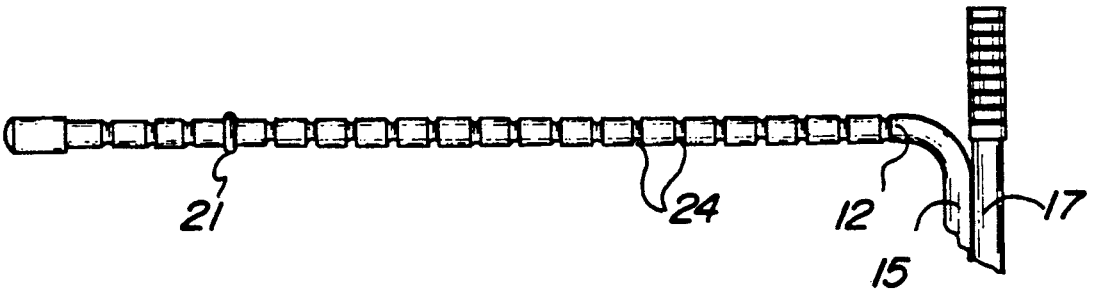
FIG. 6 is an orthographic view of a modified rigid row structure.
Figure 7:
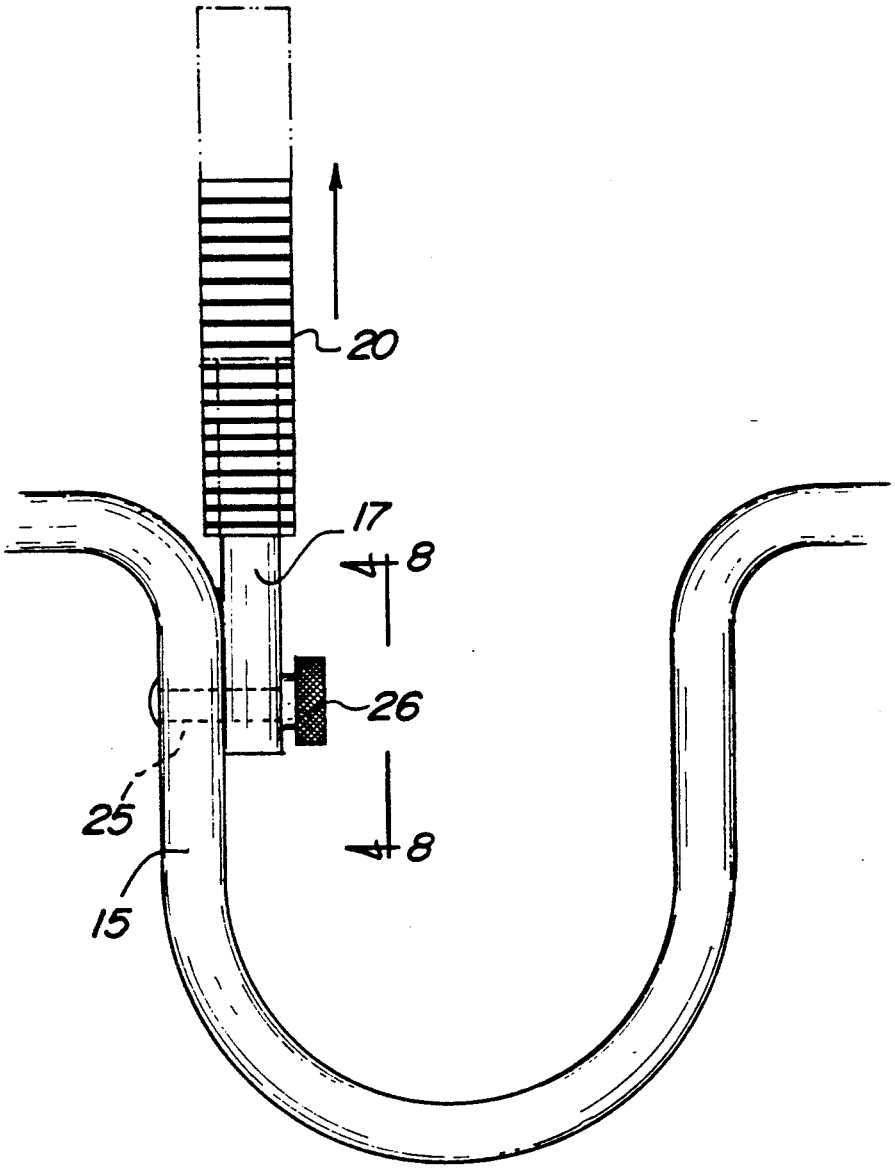
FIG. 7 is an orthographic view of the alignment rod pivotally mounted relative to the U-shaped bar structure.
Figure 8:
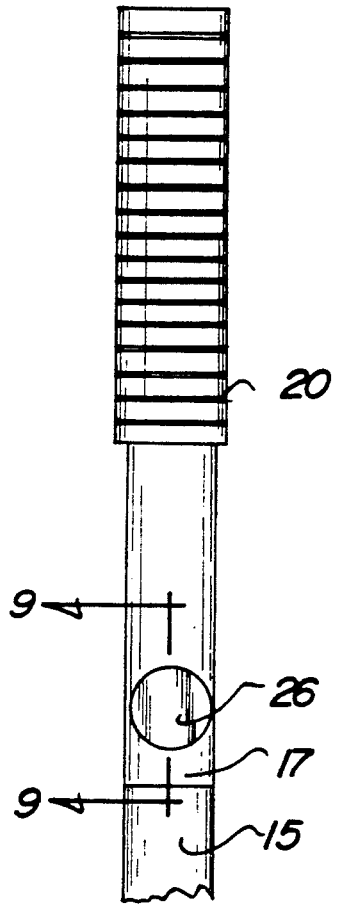
FIG. 8 is an orthographic view, taken along the lines 8—8 of FIG. 7 in the direction indicated by the arrows.
Figure 9:
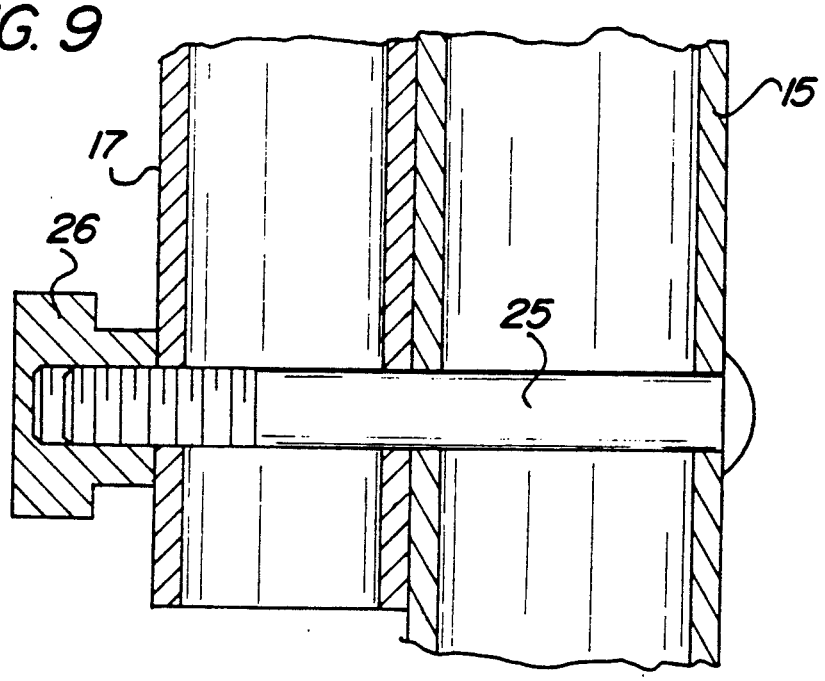
FIG. 9 is an orthographic view, taken along the lines 9—9 of FIG. 8 in the direction indicated by the arrows.

The organization as indicated in FIG. 6 indicates that the first leg 12, and it should be understood that a second leg 13 also, are to be provided with parallel grooves such as indicated by numeral 24 to more fixedly position the "O" ring relative to each rod leg such that a golfer utilizing the tool structure may not re-check the positioning of the "O" rings as the "O" rings are of a resilient structure and will accordingly engage within an associated annular groove upon being positioned in a like manner. The handle, such as indicated in the FIG. 7, may be also mounted about a lock pin 25 orthogonally directed through the bar first leg 15 and orthogonally into the alignment rod 17, with the lock pin 25 including a lock pin head 26 threadedly engaging the lock pin 25 in adjacency to the alignment rod 17. Upon loosening the head 26, the alignment rod may be interfolded for ease of storage of the organization. Further if required, the alignment rod handle 20 may be telescopingly projected relative to the alignment rod 17, wherein (see FIG. 5) a plurality of alignment rod projections 23 mounted to an exterior surface of the alignment rod frictionally engage the alignment rod handle, wherein each of the alignment rod and the handle are of a tubular construction permitting frictional telescoping of the handle relative to the rod.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the united states is as follows:

1. A golf swing and stance training tool, comprising, an elongate rigid rod, the rigid rod having a rod first leg and a rod second leg, with the rigid rod oriented about a rigid rod axis, and the rod first leg is coaxially aligned relative to the rod second leg in a spaced relationship, and a U-shaped bar, the U-shaped bar having a bar first leg and a bar second leg, with the bar first leg orthogonally and fixedly mounted to the rod first leg and the bar second leg fixedly and orthogonally mounted to the rod second leg, with the U-shaped bar oriented intermediate the rod first leg and the rod second leg, and an alignment rod, the alignment rod oriented about an alignment rod axis, and the bar first leg oriented about a first leg axis, with the alignment rod axis oriented parallel to and spaced from the first leg axis, and the alignment rod orthogonally oriented relative to the rigid rod and projecting orthogonally beyond the rigid rod from the U-shaped bar.

2. A training tool as set forth in claim 1 wherein the alignment rod includes an alignment rod handle mounted in surrounding relationship relative to the alignment rod, with the alignment rod handle originating beyond the U-shaped bar.

3. A training tool as set forth in claim 2 wherein the rod first leg includes a resilient first "O" ring secured about the rod first leg, and the rod second leg includes a resilient second "O" ring secured about the rod second leg, wherein the first "O" ring is arranged for displacement along the rod first leg and the second "O" ring is arranged for displacement along the rod second leg, wherein the first "O" ring and the second "O" ring are arranged for spacing relative to a golfer's shoulders.

4. A training tool as set forth in claim 3 wherein at least said rod first leg includes a plurality of annular parallel grooves therealong for receiving the first "O" ring.

5. A training tool as set forth in claim 4 including a lock pin orthogonally directed through the bar first leg and directed through the alignment rod, with the lock pin having a lock pin head threadedly engaging the lock pin, and the lock pin head is arranged for abutment with the alignment rod, whereupon loosening of the lock pin head relative to the lock pin permits pivoting of the alignment rod in a displaced orientation relative to the U-shaped bar.

6. A training tool as set forth in claim 5 wherein the alignment rod includes a matrix of alignment rod projections extending beyond an exterior surface of the alignment rod for frictionally engaging the handle permitting extension of the handle relative to the alignment rod in a secure cooperative relationship.

* * * * *